US005662097A

United States Patent [19]

Panos

[11] Patent Number: 5,662,097

[45] Date of Patent: Sep. 2, 1997

[54] STOVE HOOD WITH FLUID FILTER CLEANING MEANS

[76] Inventor: Mihail Panos, 2019 W. Hill Ave., Fullerton, Calif. 92633

[21] Appl. No.: 748,288

[22] Filed: Nov. 13, 1996

[51] Int. Cl.[6] ..... F24C 15/20

[52] U.S. Cl. ..... 126/299 E; 126/299 D; 55/242; 55/DIG. 36

[58] Field of Search ..... 126/299 D, 299 R, 126/299 E, 299 F; 55/DIG. 36, 242, 229, 228

[56] References Cited

U.S. PATENT DOCUMENTS

| | | | |
|---|---|---|---|
| 3,564,989 | 2/1971 | Williams | 126/299 E |
| 4,084,947 | 4/1978 | Ear | 126/299 D |
| 4,085,735 | 4/1978 | Kaufman et al. | 126/299 E |
| 4,231,769 | 11/1980 | Ahlrich | 55/DIG. 36 |
| 5,472,342 | 12/1995 | Welsh et al. | 126/299 E |

*Primary Examiner*—James C. Yeung
*Attorney, Agent, or Firm*—Beehler & Pavitt

[57] ABSTRACT

A stove hood with filters which may be flushed clean when desired, the hood having a roof, end members and a bottom trough which define at least one rectangular opening through which stove gaseous medium passes through a filter upward to an exhaust duct. A closurable member is provided for each rectangular opening and within the hood volume is provided a spray head directed to each filter and supplied with cleaning fluid under pressure when brought into the spray head via a conduit upon activation of control means. The fluid which is passed through the filter or filters is caught in the trough and discharged either into a sewer line or recycled for return cleaning of the filters.

7 Claims, 3 Drawing Sheets

STOVE HOOD WITH FLUID FILTER CLEANING MEANS

FIELD OF THE INVENTION

This invention relates, generally, to the field of stove hoods and, particularly, to a hood combination in which filters for smoke, fumes, and other gases emanation from cooking on a stove may be periodically cleaned without having to remove the filters to either wash or replace them.

BACKGROUND OF THE INVENTION

During the few decades, the restaurant and, particularly, the fast food types of outlets, have proliferated to an almost unbelievable extent, not only in the United States, but in many foreign countries.

It has always been a problem with cooking over a stove, even in homes, that with the heating of food, vapors of various types arise from the cooking utensils or from griddles or grills, which vapors or fumes are usually entrained with grease or other particulates given off by the food or by whatever is used to cook the food, e.g., grease, butter, olive oil, etc. Even in a home kitchen, after a while it will be noticed that any area above the stove becomes greasy, discolored, or both. This condition is caused by smoke, fumes or any other gaseous medium which emanates from he cooking process.

In recent years, the kitchens of many homes have been provided with some type of a hood disposed above the stove, such hood having an upper outlet, either in communication with the outside atmosphere through the house roof or, with an adjacent chimney leading up to the atmosphere. Over a period of time, the insides of these hoods will become greasy unless the rising smoke, fumes, or gaseous medium is required to be passed through some type of filter. In the case of restaurants and fast food establishments, filtering is quite necessary and, in some instances, mandated by local municipal or state codes.

The filters themselves tend to pick up and extract from the rising gaseous medium much of the entrained grease or other particulates with the result that, after a certain period of time, the filters become fouled and must be cleaned or replaced. In homes, this may become necessary only periodically, such as once every month or two. However, in the case of restaurants where cooking is engaged in during most of the restaurant's or fast food establishment's open hours, filters may become clogged, or, at least, desirable to clean them as frequently as once a day.

The desirability of cleaning filters by washing and without removing the filters from a hood or other structure above the cooking area has long been recognized as many expedients have been devised to effect such washing. Examples of such expedients may be found in the following U.S. Pat. Nos. 3,785,124, 3,805,685 3,854,388, 4,071,019, 4,101,299, and 4,231,769. The apparatus of some of these patents may be found to be effective, but their cost in installing them may be too great, particularly where a system is desired for a residential use.

What is needed therefore is a relatively simple system which can be installed in residences at a reasonable price and can also be adapted in larger sizes for use in restaurants or other commercial food establishments.

SUMMARY OF THE INVENTION

The present invention comprises a hood placed above a stove. The hood has a roof and end member extending downwardly from the roof. The lower ends of the end members are bridged by a bottom wall and partial side walls arising from the sides of the bottom wall to define a trough. The trough has an outlet for the passage of liquid; the roof has an opening to encompass the lower end of a duct which leads to the atmosphere through the building roof or a chimney, and supports a propeller assembly which draws fumes or smoke entering the hood and propelling it up into the duct. The roof, together with the end members and the trough define at least one rectangular opening on a side of the apparatus on the inside of which is disposed a filter screen and on the outside of which a closure member which is hinged to move between a first open position and a second closed position. When this closure member is in its second position, it, together with a hood, the end member and the trough define a volume within which is disposed conduit means leading from a source of fluid under pressure and terminating in a spray head or array. The spray head or array may be disposed in close proximity to the filter screen or screens. Control means are provided to direct the fluid under pressure into the spray head or array to be discharged against the filter screen or screens when the closure member or members are disposed in their second positions. The cleaning fluid which drops down into the trough is removed through the outlet either to be discharged into a sewer line or recycled for redelivery as a part of the fluid source under pressure.

The apparatus of the present invention may be adapted for placement either over a stove which abuts a kitchen wall or over a stove disposed in a kitchen island. In the former case, the hood may have a rectangular opening on either side of the hood, but where the stove is a part of a kitchen island, rectangular openings with filter closure members and spray heads may be provided on opposite sides of the apparatus.

Whenever it is desired to clean the filter or filters, the closure member or members are brought down and locked in place, and the control means is operated to allow fluid under pressure to be discharged from the spray head or array against the filter screen or screens. In some instances, very hot water may be effective to clean the screens, but generally it will be found that by including some detergent in the hot liquid, the cleaning of the screens may be much more effective.

The apparatus of the present invention may be in the form of a single unit, as generally for residential applications; or in multiple side-by-side units for commercial establishments.

Because of the simplicity of the apparatus and its method of operation, the present invention offers many advantages over prior art stove screen cleaners.

DESCRIPTION OF THE DRAWINGS

In the accompanying drawings.

DESCRIPTION OF THE PREFERRED EMBODIMENT

Figure 1:
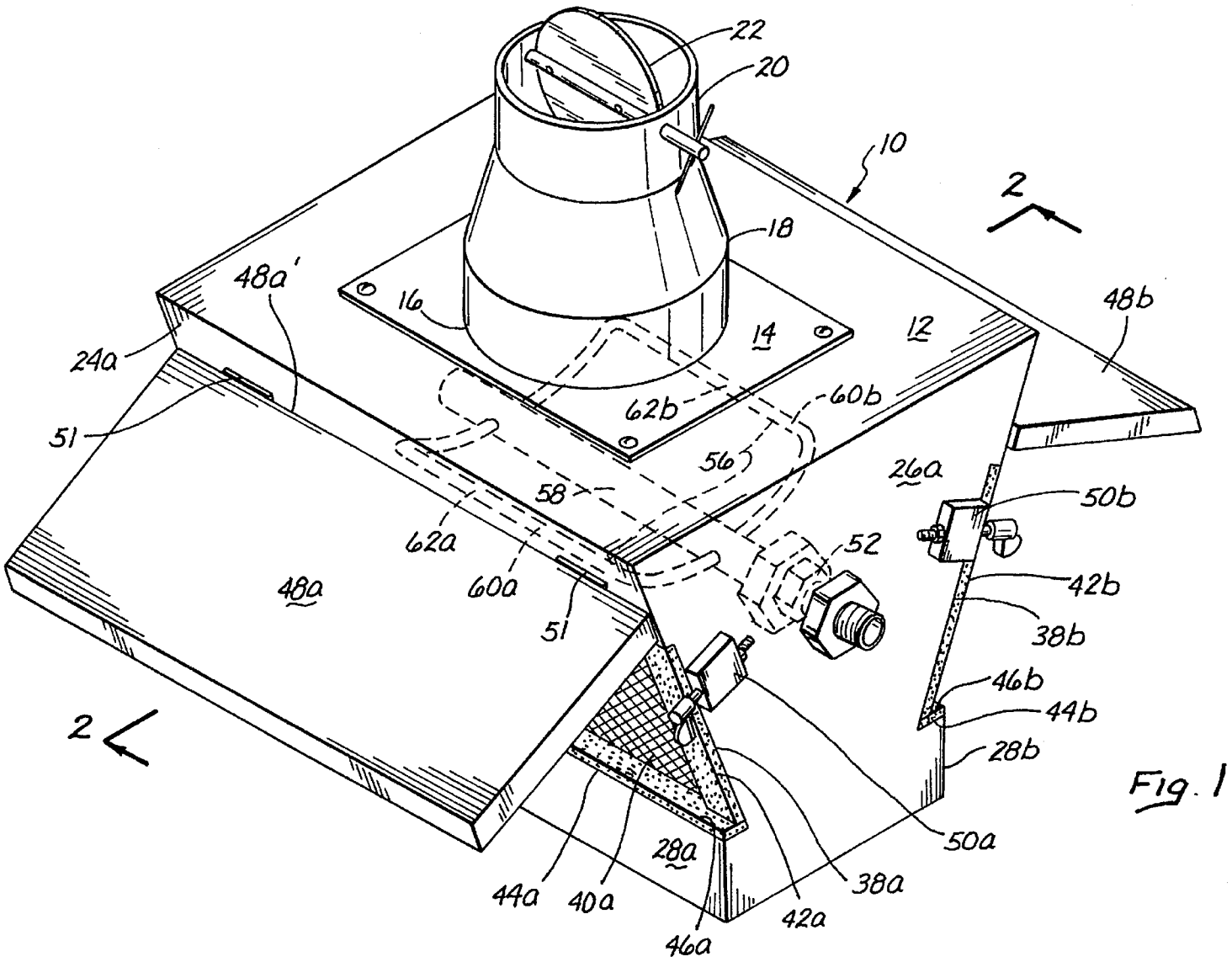
FIG. 1 is a perspective view of the apparatus.

Referring to FIG. 1 of the drawings, the apparatus of the present invention as illustrated in that figure comprises a hood 10 having a roof 12 which includes a rectangular plate 14 having an opening 16 and a sleeve 18 which is attachable to the lower end of a duct 20. The latter may be opened or closed by the rotatable butter-fly valve 22.

The roof 12 may include a pair of upper side members 24*a* and 24*b* and a pair of end members 26*a* and 26*b* bridged at their lower ends by side walls 28*a* and 28*b*, and a bottom wall 30 to form a trough 32, having a bottom outlet 34. The bottom wall 30 desirably has a pair of longitudinal ridges 36*a* and 36*b* which may extend for the length of the trough 32.

The partial side walls 28*a* and 28*b* together with the side edges 38*a* and 38*b* and the bottom edges 24*a*' and 24*b*' of the upper edges 24*a*, 24*b* of the roof 12, define a pair of rectangular openings 40*a* and 40*b*. The side edges of these rectangular openings 48*a* and 48*b* may be covered by channel members 42*a*, 42*b*, and the bottom edges 44*a* and 44*b*, by a neoprene or rubber-like bar 46*a*, 46*b*, respectively.

Figure 2:
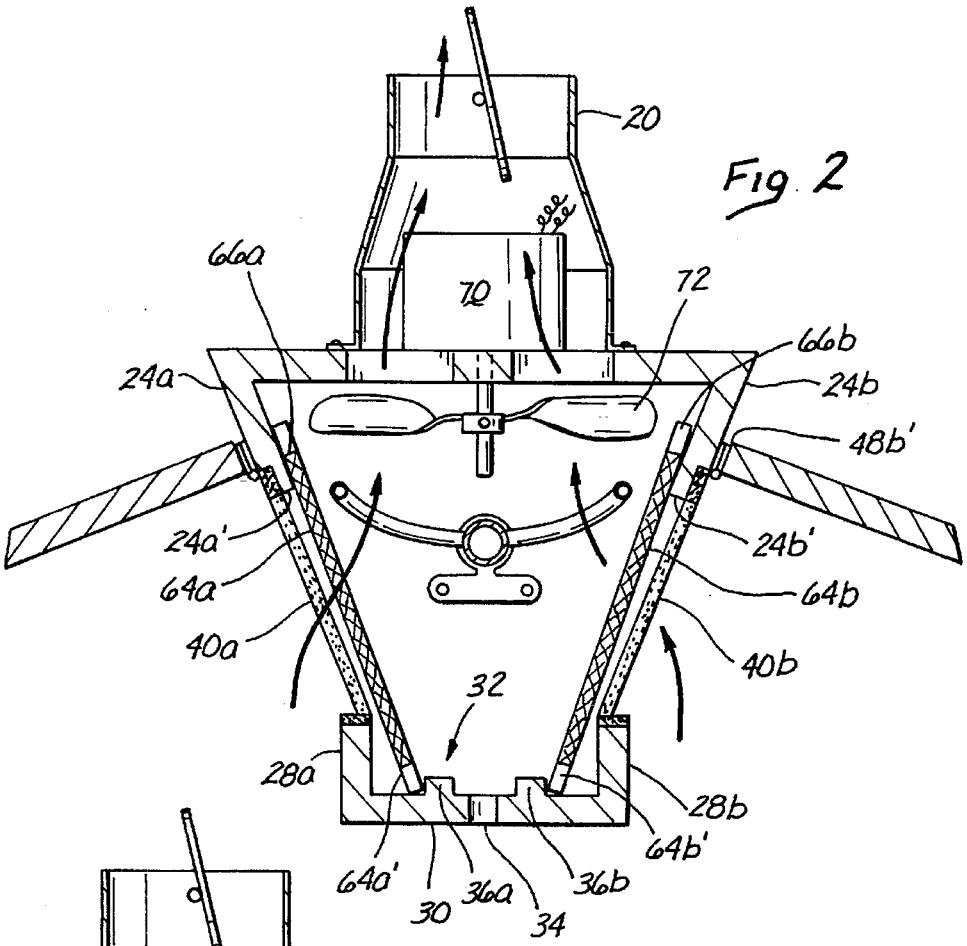
FIG. 2 is a section taken on the line 2—2 of FIG. 1 with the closure members in open position.
Figure 3:
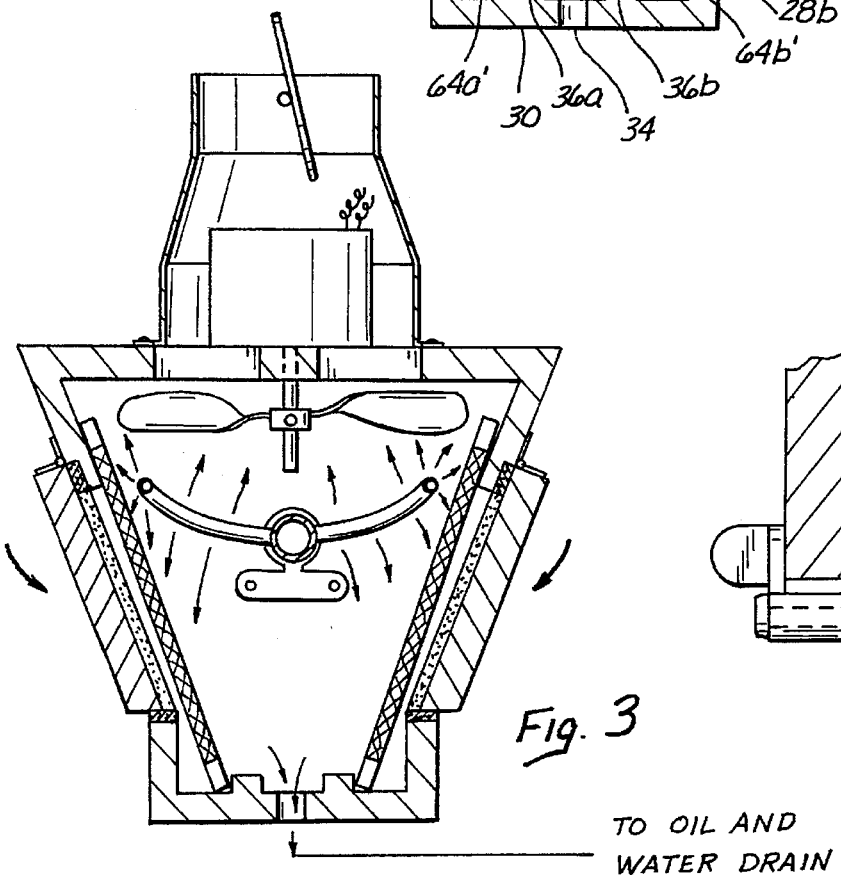
FIG. 3 is a section similar to FIG. 2 but showing the closure members in closed position with fluid under pressure being discharged and removed in the direction of the arrows.
Figure 4:
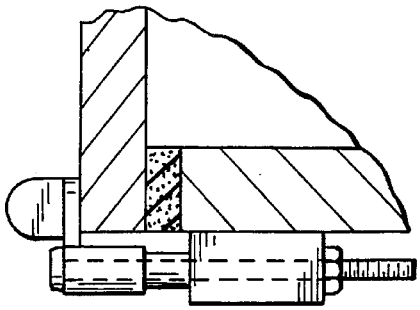
FIG. 4 is an enlarged sectional view of the locking device shown in Figure in locked position.
Figure 5:
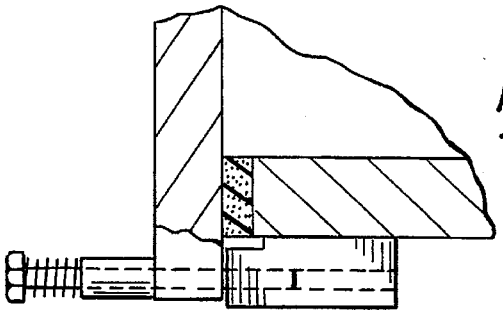
FIG. 5 is a sectional view similar to FIG. 4 showing an alternate form of locking device.
Figure 6:
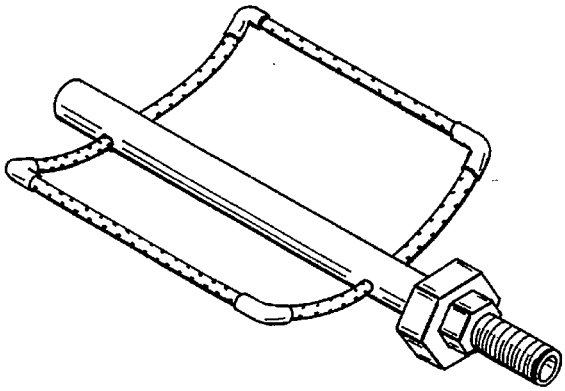
FIG. 6 is a perspective view of the spray head device shown in FIGS. 1–3.

Each rectangular opening 40*a*, 40*b* is provided with a closure member 48*a*, 48*b*, respectively which is hinged at 51 along its upper edge 48*a*', 48*b*' to swing between an open position, as shown in FIG. 2, and a closed position as shown in FIG. 3. Locking means 50*a* and 50*b* are provided to secure the closure members 48*a* and 48*b*, respectively in their position shown in FIG. 3. The hinge 51 is preferrably of the type which may catch in the open position, but be released for closing to FIG. 3 position.

Figure 7:
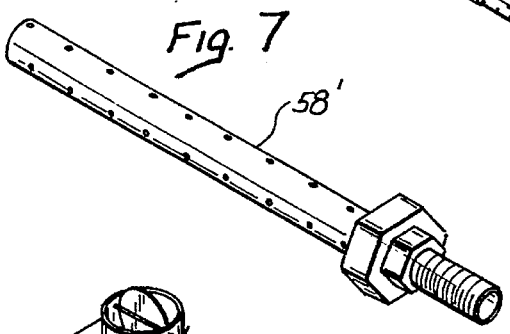
FIG. 7 is a perspective view of an alternate spray head.

The end member 26*a* is orificed to enable a conduit 52 to be passed through the wall. The conduit 52, as shown schematically in FIG. 8, may be connected to a pump 54 or other source of fluid under pressure and terminates within the hood 10 in a spray head arrangement 56 which, as illustrated, comprises a central pipe 58 and a pair of distribution pipes 60*a* and 60*b*, each having a longitudinal section 62*a* and 62*b* which is disposed in close proximity to the respective rectangular openings 40*a* and 40*b*. Disposed over the insides of these openings 40*a* and 40*b* are a pair of filter screens 64*b*. The lower edges 64*a*', 64*b*' will seat against the longitudinal ridges 36*a*, 36*b*, respectively, in the trough 32, and the upper edges of the filter screens 64*a* and 64*b*, respectively, may be secured to or even simply permitted to rest against the insides of the side walls 24*a*, 24*b* of the roof 12. Control means 68 may be provided to enable the fluid under pressure from the pump 54 to be brought into the conduit 52 for discharge through the U-shaped pipes 62*a*, 62*b*. In an alternate embodiment shown in FIG. 7 which might be suitable in the case of a small hood 10 (not shown), the discharge of the fluid under pressure could be accomplished through a single central pipe 58'.

For the hood no be effective in drawing smoke or fumes into the hood and propelling it up through the duct 20, a motor 70 may 20 be provided to drive the propeller 72 disposed at the entrance to or even in the duct 20.

In use, with the hood 10 properly installed, the propeller 72 is driven by the motor 70 to suck air through the rectangular openings 40*a* and 40*b* to draw the objectionable gaseous medium through the filter screens 64*a* and 64*b*. When it is desired to clean these filter screens, the closure members 48*a* and 48*b* are swung down to seat on the neoprene bars 36*a*, 46*b*, and the closure members 48*a*, 48*b* are then locked in their closed position, shown in FIG. 3. Control means 68, Which may be a conventional valve, is operated to allow fluid under pressure from the pump (or other pressure source) to enter the central pipe 58 from which it may pass into the U-shaped spray pipes 62*a*, 62*b* for discharge laterally against the screen members 64*a*, 64*b*. The cleaning fluid drops into the trough 32 from which it flows through the outlet 34, either to a sewer pipe (not shown) or for recycling back to a storage tank 74 as shown schematically in FIG. 8.

When it is felt that sufficient cleaning has been effected, the control means 68 is operated to shut off further fluid and the closure members 48*a*, 48*b* are moved back to their open position shown in FIG. 2.

Figure 8:
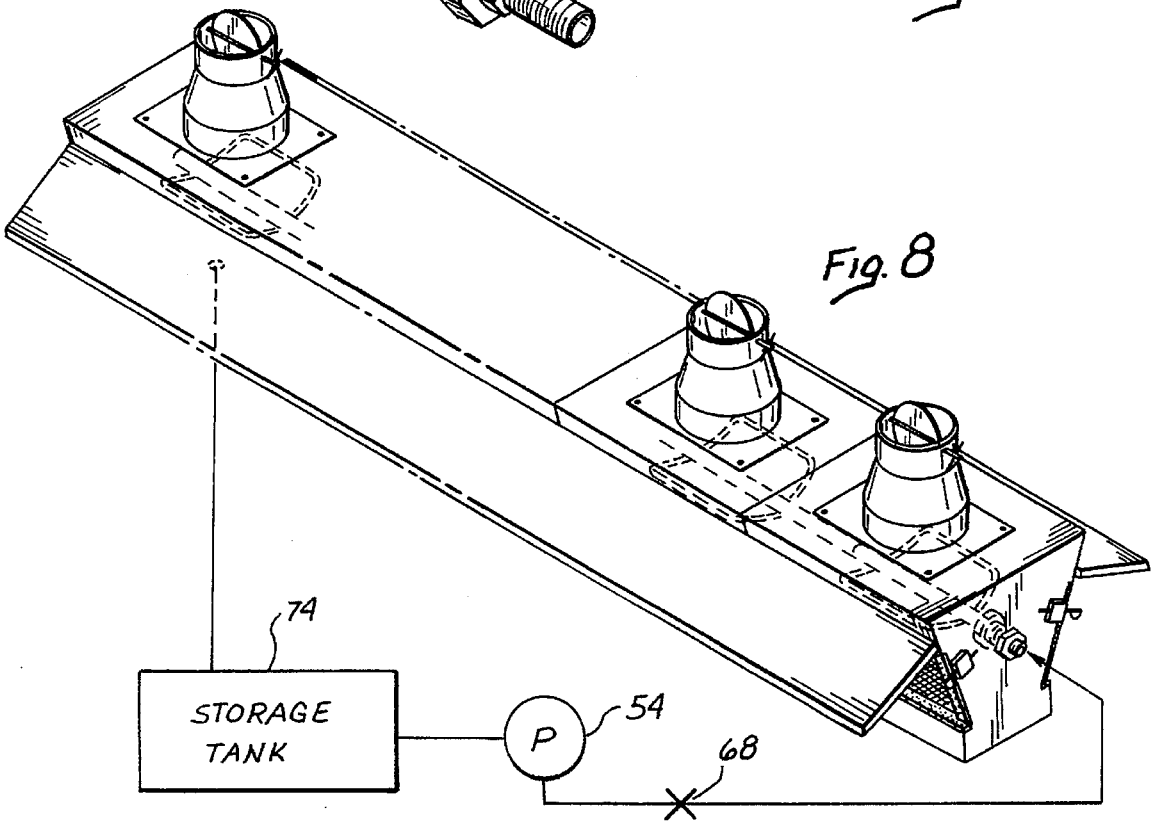
FIG. 8 is a perspective view of apparatus according to the present invention in which a plurality of ducts and spray heads are utilized above a large range or stove, such as would be utilized in a commercial type-kitchen.

The apparatus thus is both simple and effective. Where it is desired to utilize the principle of the present invention for a commercial operation, a plurality of units may be employed as shown in FIG. 8.

The present invention therefore offers many advantages over the prior art.

I claim:

1. In combination, with a stove in which food is cooked, an exhaust air duct serving to conduct upwardly to a predetermined area any gaseous medium entrained with particles of grease or other by-products of cooking on the stove, said duct having a lower end, and an upper end in communication with said predetermined area, said lower end being disposed above the stove and having in association therewith means to propel the gaseous medium into and through the duct;

a hood interposed between the stove and the lower end of the duct and said hood being in communication in its upper region with the lower end of said duct, whereby any gaseous medium arriving within the hood passes upwardly into and through the duct at the urging of the propelling means; said hood further comprising:

a rectangular roof, said roof having ends and sides and encompassing the lower end of the duct;

a pair of end members, each of said members being secured to one of the ends of the rectangular roof and extending downwardly to terminate at a bottom wall, said bottom wall being attached to the lower portions of said end members and said lower portions being further connected by partial side walls extending upwardly from the bottom wall to form, with said partial side walls, a trough, said trough having a bottom outlet, each said partial side wall together with adjacent portions of a member and a side edge of the roof defining a rectangular area, a framed filter screen removably disposable to cover the inside of said rectangular area;

a pair of closure members, each of said closure members being of a configuration to completely cover one of said rectangular areas, each said closure member being hinged outside of said rectangular areas and being adapted to swing between a first position in which access through the rectangular area is unobstructed, and a second position in which the rectangular area is closed in a substantially watertight manner;

said roof, said end members, said trough, and said closure members together defining a volume, a liquid sprayhead supported within said volume, said sprayhead having orifices directed against each filter screen, a source of fluid under pressure, said fluid being effective for dissolving and removing grease and other particles from the filter screen, said sprayhead being connectable to said source of fluid under pressure; and control means adapted to connect said sprayhead to said source of fluid whereby when the closure members are disposed in their first positions, the filter screens serve to remove grease and other entrained cooking by-products from the gaseous medium being drawn from above the stove and into and through the duct by the propelling means; but, when the closure members are disposed in their second positions, and the control means is operated to connect the sprayhead to the source of fluid under pressure, the filter screens are flushed and cleaned by the fluid which then passes down through the outlet in the bottom wall.

2. The combination as described in claim 1, wherein means are provided between the outlet of the bottom wall and the source of fluid under pressure whereby the fluid which passes through the outlet may be returned for reuse as fluid under pressure.

3. The combination as described in claim 1, wherein locking means are provided on the outside of the rectangular area, said locking means being adapted to secure the closure members in their second positions to close said rectangular area, during the period when the screens are being flushed by fluid under pressure emanating from the sprayhead.

4. The combination as described in claim 1, wherein the sprayhead is comprised of a length of pipe passed through one of the end members and is centrally disposed within the volume, one end of said pipe being placed in communication with the source of fluid under pressure, and there extends from each side of the pipe an orificed U-shaped pipe in communication with the pipe from which it extends, the orifices in the U-shaped pipe being disposed close to the screen on each side of the volume and directed towards the screen.

5. In combination, with a stove in which food is cooked, an exhaust air duct serving to conduct upwardly to a predetermined area any gaseous medium entrained with particles of grease or other by-products of cooking on the stove, said duct having a lower end, and an upper end in communication with said predetermined area, said lower end being disposed above the stove and having in association therewith means to propel the gaseous medium into and through the duct;

a hood interposed between the stove and the lower end of the duct and said hood being in communication in its upper region with the lower end of said duct, whereby any gaseous medium arriving within the hood passes upwardly into and through the duct at the urging of the propelling means; said hood further comprising:

a rectangular roof, said roof having ends and sides and encompassing the lower end of the duct;

a pair of end members, each of said members being secured to one of the ends of the rectangular roof and extending downwardly to terminate at a bottom wall, said bottom wall being attached to the lower portions of said end members and said lower portions being further connected by a rear wall extending up to the roof and a forward partial side wall extending upwardly from the bottom wall to form, with said rear wall and said partial side wall, a trough, said trough having a bottom outlet, said partial side wall together with adjacent portions of an end member and a side edge of the roof defining a rectangular area, a framed filter screen removably disposable to cover the inside of said rectangular area;

a closure member, said closure member being of a configuration to completely cover said rectangular area, said closure member being hinged outside of said rectangular area and being adapted to swing between a first position in which access through the rectangular area is unobstructed, and a second position in which the rectangular area is closed in a substantially water-tight manner;

said roof, said end members, said trough, said rear wall and said closure member together defining a volume, a liquid sprayhead supported within said volume, said sprayhead having orifices directed against the filter screen, a source of fluid under pressure, said fluid being effective for dissolving and removing grease and other particles from the filter screen, said sprayhead being connectable to said source of fluid under pressure; and control means adapted to connect said sprayhead to said source of fluid whereby when the closure member is disposed in its first position, the filter screen serves to remove grease and other entrained cooking by-products from the gaseous medium being drawn from above the stove and into and through the duct by the propelling means; but, when the closure member is disposed in its second position, and the control means is operated to connect the sprayhead to the source of fluid under pressure, the filter screen is flushed and cleaned by the fluid which then passes down through the outlet in the bottom wall.

6. The combination as described in claim 5, wherein the bottom wall is provided with a longitudinal ridge proximate to the partial side wall and the bottom of the filter screen may be disposed between said ridge and said partial side wall.

7. The combination as described in claim 5 wherein the closure member is hinged along the upper edge of the rectangular area, and means are provided temporarily to hold the closure member in its first position.

* * * * *